US008745894B2

(12) United States Patent
Cheskin et al.

(10) Patent No.: US 8,745,894 B2
(45) Date of Patent: Jun. 10, 2014

(54) TRIPLE DENSITY GEL INSOLE

(75) Inventors: Melvyn P. Cheskin, Deerfield Beach, FL (US); David Bradley Granger, Lorena, TX (US); Jacob Martinez, Temple, TX (US); Duane M. Sulak, Waco, TX (US)

(73) Assignee: Spenco Medical Corporation, Waco, TX (US)

( * ) Notice: Subject to any disclaimer, the term of this patent is extended or adjusted under 35 U.S.C. 154(b) by 878 days.

(21) Appl. No.: 12/668,983

(22) PCT Filed: Sep. 11, 2008

(86) PCT No.: PCT/US2008/076019
§ 371 (c)(1),
(2), (4) Date: Jan. 13, 2010

(87) PCT Pub. No.: WO2009/036173
PCT Pub. Date: Mar. 19, 2009

(65) Prior Publication Data

US 2010/0205831 A1 Aug. 19, 2010

Related U.S. Application Data

(60) Provisional application No. 60/972,540, filed on Sep. 14, 2007.

(51) Int. Cl.
*A43B 13/38* (2006.01)
*A43B 7/14* (2006.01)
*A43B 7/06* (2006.01)

(52) U.S. Cl.
USPC ..... 36/44; 36/88; 36/3 R

(58) Field of Classification Search
USPC ..... 36/43, 44, 153
See application file for complete search history.

(56) References Cited

U.S. PATENT DOCUMENTS

| | | | | | |
|---|---|---|---|---|---|
| 2,090,881 | A | * | 8/1937 | Wilson | 36/29 |
| 2,347,207 | A | * | 4/1944 | Margolin | 36/3 B |
| 2,553,616 | A | * | 5/1951 | Walls | 36/29 |
| 4,020,570 | A | | 5/1977 | Shames | |
| 4,694,831 | A | * | 9/1987 | Seltzer | 36/141 |
| 4,864,740 | A | * | 9/1989 | Oakley | 36/44 |
| 4,888,887 | A | * | 12/1989 | Solow | 36/3 R |
| 5,092,060 | A | * | 3/1992 | Frachey et al. | 36/29 |

(Continued)

FOREIGN PATENT DOCUMENTS

| | | |
|---|---|---|
| KR | 20-1993-0024801 | 12/1993 |
| KR | 20-0427687 | 9/2006 |

*Primary Examiner* — Khoa Huynh
*Assistant Examiner* — Timothy K Trieu
(74) *Attorney, Agent, or Firm* — Hemingway & Hansen, LLP; D. Scott Hemingway

(57) ABSTRACT

A triple density replacement insole which has at least two coextensive layers of different densities which are adjacent one another and extending the length of the insole comprising a first top cloth layer and a second gel layer and a third density layer comprising a stability cradle adjacent the gel layer. In a preferred embodiment, the stability cradle, which extends from the arch area to the heel area and secures to the gel layer, defines a first metatarsal region gap which exposes the gel layer and a second heel region gap which exposes the gel layer. A heel cushion is positioned in the second heel region gap adjacent to the gel layer and is secured to the gel layer exposed in that region. A metatarsal arch support is integrally formed in the first metatarsal region gap area.

16 Claims, 2 Drawing Sheets

(56) References Cited

U.S. PATENT DOCUMENTS

| | | | | |
|---|---|---|---|---|
| 5,155,927 | A * | 10/1992 | Bates et al. | 36/28 |
| 5,197,207 | A * | 3/1993 | Shorten | 36/29 |
| 5,201,125 | A * | 4/1993 | Shorten | 36/29 |
| 5,369,896 | A * | 12/1994 | Frachey et al. | 36/29 |
| 5,619,809 | A * | 4/1997 | Sessa | 36/3 R |
| 5,685,094 | A * | 11/1997 | Lin | 36/141 |
| 5,727,336 | A * | 3/1998 | Ogden | 36/43 |
| 5,771,606 | A * | 6/1998 | Litchfield et al. | 36/29 |
| 6,176,025 | B1 * | 1/2001 | Patterson et al. | 36/28 |
| 6,192,607 | B1 * | 2/2001 | Kolada et al. | 36/145 |
| 6,233,847 | B1 * | 5/2001 | Brown | 36/44 |
| 6,301,805 | B1 | 10/2001 | Howlett et al. | |
| 6,502,330 | B1 * | 1/2003 | David et al. | 36/88 |
| 6,631,568 | B2 * | 10/2003 | Howlett et al. | 36/43 |
| 6,893,453 | B2 * | 5/2005 | Agarwal et al. | 607/108 |
| 6,944,974 | B2 * | 9/2005 | Falone et al. | 36/44 |
| 6,991,691 | B2 * | 1/2006 | Yoon | 156/92 |
| 7,047,671 | B2 * | 5/2006 | Steed et al. | 36/44 |
| 7,082,702 | B2 * | 8/2006 | Cretinon | 36/88 |
| 7,107,705 | B2 * | 9/2006 | Dalton et al. | 36/44 |
| 7,124,520 | B2 * | 10/2006 | Galbraith et al. | 36/43 |
| D551,437 | S * | 9/2007 | Hung et al. | D2/961 |
| 7,644,522 | B2 * | 1/2010 | Ramirez | 36/160 |
| 7,665,169 | B2 * | 2/2010 | Cheskin et al. | 12/146 B |
| D627,958 | S * | 11/2010 | Cheskin et al. | D2/961 |
| 7,908,768 | B2 * | 3/2011 | Cheskin et al. | 36/44 |
| 8,015,728 | B2 * | 9/2011 | Benfatti | 36/2.6 |
| 8,069,586 | B2 * | 12/2011 | Orvitz | 36/44 |
| 8,186,081 | B2 * | 5/2012 | Wilson et al. | 36/76 R |
| 8,250,784 | B2 * | 8/2012 | Cheskin et al. | 36/44 |
| 2002/0007569 | A1 * | 1/2002 | Crane et al. | 36/44 |
| 2002/0083618 | A1 * | 7/2002 | Erickson et al. | 36/44 |
| 2003/0093920 | A1 * | 5/2003 | Greene et al. | 36/25 R |
| 2003/0121180 | A1 | 7/2003 | Poe | |
| 2004/0118017 | A1 * | 6/2004 | Dalton et al. | 36/44 |
| 2004/0194344 | A1 * | 10/2004 | Tadin | 36/44 |
| 2006/0000120 | A1 * | 1/2006 | Chenut et al. | 36/144 |
| 2006/0123664 | A1 * | 6/2006 | Boyd et al. | 36/44 |
| 2006/0230643 | A1 * | 10/2006 | Affleck | 36/153 |
| 2006/0277797 | A1 * | 12/2006 | McLinden | 36/44 |
| 2006/0277801 | A1 * | 12/2006 | Schwarze et al. | 36/141 |
| 2007/0033834 | A1 * | 2/2007 | Cheskin et al. | 36/44 |
| 2007/0084084 | A1 * | 4/2007 | Rich | 36/44 |
| 2007/0107261 | A1 * | 5/2007 | Cheskin et al. | 36/44 |
| 2008/0115385 | A1 * | 5/2008 | McLinden | 36/44 |
| 2008/0271340 | A1 * | 11/2008 | Grisoni et al. | 36/43 |
| 2009/0151194 | A1 * | 6/2009 | Cheskin et al. | 36/28 |
| 2010/0205831 | A1 * | 8/2010 | Cheskin et al. | 36/44 |
| 2012/0047768 | A1 * | 3/2012 | Brave | 36/43 |

* cited by examiner

TRIPLE DENSITY GEL INSOLE

CROSS REFERENCE TO RELATED APPLICATIONS

Not Applicable

STATEMENT REGARDING FEDERALLY SPONSORED RESEARCH OR DEVELOPMENT

Not applicable.

TECHNICAL FIELD

This invention relates to the field of replacement insoles for shoes.

BACKGROUND

Shoes, particularly athletic shoes, generally have an insole placed within the foot-receiving compartment when sold. The insole is positioned so that the user's foot will rest thereon while wearing the shoe. Generally, such insoles are removable and may be replaced with insoles which may employ various features of benefit to the user or the particular needs of the user's feet.

DETAILED DESCRIPTION

Figure 1:
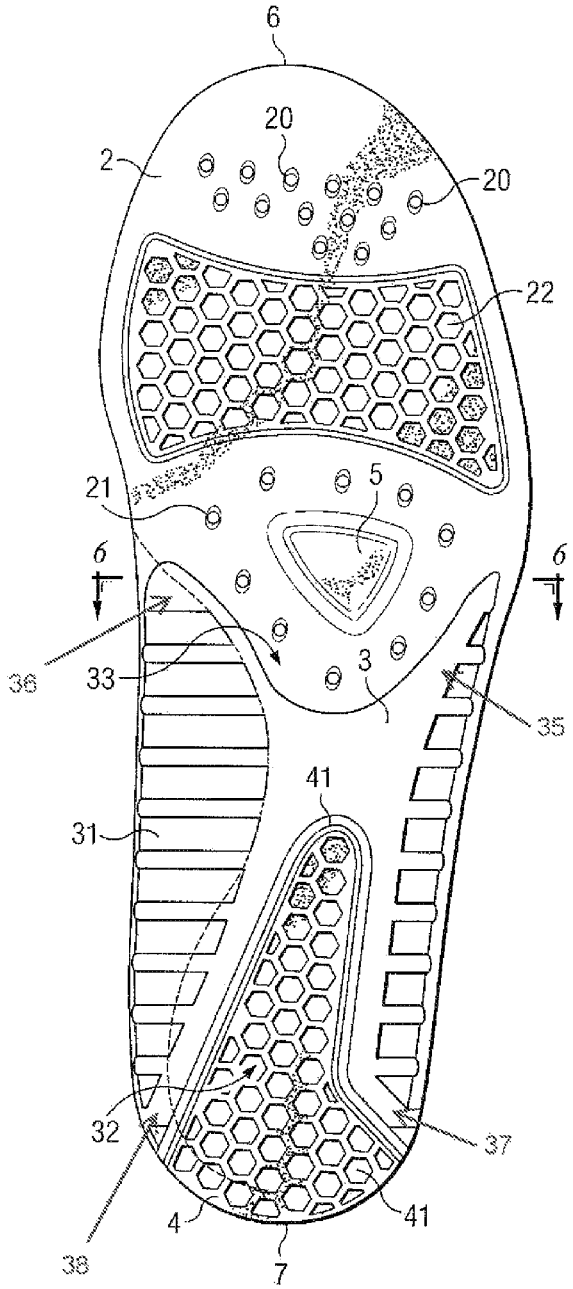
FIG. 1 is a bottom view of an embodiment of the present invention.

A triple density gel insole is disclosed that advantageously absorbs shock and provides support to areas of the feet most subject to increased force or pressure during standing, walking or other activities. The insole comprises at least two coextensive layers adjacent one another and extending the length of the insole, a first top cloth layer and a second gel layer. The insole further comprises a stability cradle adjacent said gel layer, extending from the arch to the heel area and secured to the gel layer, said stability cradle defining a first metatarsal region gap which exposes the gel layer and a second heel region gap which exposes the gel layer. A heel cushion is positioned in the second heel region gap adjacent to and secured to said gel layer exposed in that region. A metatarsal arch support is preferably integrally formed in said first metatarsal region and appears as an indented area when viewed from the underside of the insole and a raised area (or convex bump) when viewed from the top of the insole. The metatarsal arch support is formed from the first top cloth and second gel layers as will be further detailed below. This metatarsal arch support functions to offload pressure on the metatarsal heads of the foot.

The first top cloth layer is made of sheet material in the shape of an insole or outline of a foot. Most preferably, a laminated fabric sheet having at least two layers is utilized. One of the layers of the laminated fabric sheet is preferably a non-woven fabric suitable as a barrier layer. The barrier layer prevents bleed-through of the gel component of the insole. It may also enhance or modify the desired color of the gel by employing a color that will provide the desired aesthetic quality. It has been found that a white fabric adjacent the gel will enhance the color of the gel. The fabric adjacent the gel layer in the assembled insole should also be able to form a good bond with the gel utilized.

The fabric or fabric layer which will lie adjacent the foot in use can be selected of any fabric which is capable of lamination with a barrier layer, or which can itself serve as a barrier layer if a single layer of fabric is employed. A preferred sheet material is a polyester fabric, but other fabrics such as brushed nylon and others may be used. Optionally, a fabric that reduces friction between the material and the person's foot may be employed. The fabric can be of any desired color.

Most preferably, an antimicrobial fabric is used, such as antimicrobial polyester. The antimicrobial fabric is preferred so that odor-causing bacteria will be inhibited. Fabrics having these properties are commercially available. One suitable fabric utilizes silver technology for antimicrobial purposes and is obtainable through Thompson Research Associates (Toronto, Canada) in fabrics employing SILPURE™ technology. In a preferred embodiment, fabric sold under the trade designation Ultra-Fresh Silpure FBR-5 is utilized, which provides control of bacterial growth even after extensive launderings. Other fabrics can be employed which use other types of antimicrobial technology, preferably long lasting action.

The second gel layer is preferably comprised of thermoplastic elastomer gel, also known as TPE gel. TPE gel is preferred over polyurethane (PU) gel for use in the invention due to its greater resiliency from its thermoplastic properties. TPE gel is desirable because it can set up in 20-30 seconds in a molding process, while other materials, for example PU gel can take minutes. If a material takes minutes to set up, it may not be suitable for injection molding in an efficient manner, but would necessitate different components of the insole to be molded in parts and then assembled. The material used for the second gel layer is preferably strong to allow the insole to be made relatively thin, but to remain strong. The thin nature of the insole is preferred to allow for greater foot space in shoes designed with lesser space in the foot cavity of the shoe, such as dress shoes. The insole is also, however, suitable for use in shoes with a larger foot cavity, such as athletic shoes.

There are various types of TPE gel, two of which are known as a thermoplastic polyurethane elastomer ("TPU") gel and thermoplastic rubber gel ("TPR") gel. TPU gel may be selected if the color characteristics are of high importance, as it provides better color characteristics than TPR gel. In addition, TPU is more durable and easier to mold than TPR gel so it is desirable for use in making the invention if it is desired to impart these characteristics to the final product or to the process for making the insole. A disadvantage to TPU gel has heretofore been its higher cost as compared with other TPE gels such as TPR gel. TPR may also be used for the gel and has the necessary properties.

Other gels can be used, but it is preferred that the gel used have the characteristics described in the following paragraphs.

The preferred gel has a low compression set. Compression Set is defined as the amount of permanent set a sample displays after being compressed at a stated amount of percentage (%) at a specific temperature for a given amount of time and recovery period. In a preferred embodiment, the Compression Set is <11% for the gel layer. In order to select an appropriate gel for use in the invention, gel can be tested with a testing device used for the measurement of the compression set, or shock, in accordance with ASTM F1614-95, "Standard Test Method for Shock Attenuating Properties of Materials Systems for Athletic Footwear," ASTM International For example, CompITS or Computerized Impact Testing System from Exeter Research is a standard machine that tests shock in compliance with ASTM F1614-95.

Tensile and Tear strengths: The preferred embodiment was found to have a tensile strength and tear strength of around 1.2 MPa and 12 kN/m for the gel layer.

Breaking Elongation Rate: The preferred embodiment was found to have a breaking elongation rate of 900% for the gel layer.

A Shore/Asker Hardness test provides a measure of hardness. In a most preferred embodiment, the gel layer measures 24 Asker C.

The Shore/Asker hardness is measured with a commercially available durometer. The material to be tested is placed on a hard flat surface. The Asker tester is equipped with a "C" scale and proper indentor type, typically a hemispherical type. The Asker tester is placed on the material to be tested with no additional pressure. The needle deflects to provide the reading.

The shoe surface of the gel layer is preferably provided with areas which exhibit advanced cushioning features. These areas are located in the areas of high impact of the heel and forefoot for the best benefit. A preferred embodiment incorporates honeycomb technology, by which a portion of the gel layer is molded into a honeycomb pattern. Honeycomb patterns have long been known to deflect force by temporarily deforming then returning to original configuration. See "Recovery Systems Guide", Irvin Industries, 1978 (cited in Fisher, Aerobraking and Impact Attenuation, 1995).

The second gel layer, the heel cushion, and the cradle are preferably formed and secured to each other through a process of injection molding. Preferably, the molds used to make the insole have two-sided contour. This allows for quicker assembly so that the mold does not have to be changed during the injection molding process. The gel layer is molded on one side of the mold and the cradle and heel cushion is molded on the opposite side of the mold. Standard injection molding assembly-line processes are preferably utilized, but any molding process which results in the structure with the properties herein disclosed can be used are known in the art.

The stability cradle helps to support the longitudinal arch area of the foot on the medial side, control or eliminate pronation and control or eliminate supination on the lateral side of the foot. It is to be made of a material more rigid than the gel. Preferably, the stability cradle is made of TPR.

In a preferred embodiment, the Compression Set is <25% for the cradle. In order to select an appropriate gel for use in the invention, gel can be tested with a testing device used for the measurement of the compression set, or shock, in accordance with ASTM F1614-95, "Standard Test Method for Shock Attenuating Properties of Materials Systems for Athletic Footwear," ASTM International. For example, CompITS or Computerized Impact Testing System from Exeter Research is a standard machine that tests shock in compliance with ASTM F1614-95.

Tensile and Tear strengths: The preferred embodiment was found to have a tensile strength and tear strength of around 6.3 MPa and 27 kN/m for the cradle.

Breaking Elongation Rate: The preferred embodiment was found to have a breaking elongation rate of 550% for cradle.

A Shore/Asker Hardness test provides a measure of hardness. In a most preferred embodiment, the cradle measures 70 Asker C.

The heel cushion is preferably made of a gel which provides added cushioning to the heel area of the foot of a user at heel strike. The gel composition of the heel cushion is preferably TPE. In one embodiment, the TPE is a TPR. The heel cushion gel is preferably a softer gel than that of the second gel layer.

In a preferred embodiment, the Compression Set is <11% for the heel pad. In order to select an appropriate gel for use in the invention, gel can be tested with a testing device used for the measurement of the compression set, or shock, in accordance with ASTM F1614-95, "Standard Test Method for Shock Attenuating Properties of Materials Systems for Athletic Footwear," ASTM International. For example, CompITS or Computerized Impact Testing System from Exeter Research is a standard machine that tests shock in compliance with ASTM F1614-95.

Tensile and Tear strengths: The preferred embodiment was found to have a tensile strength and tear strength of around 1.0 MPa and 10.6 kN/m for the heel cushion.

Breaking Elongation Rate: The preferred embodiment was found to have a breaking elongation rate of 950% for the heel cushion.

A Shore/Asker Hardness test provides a measure of hardness. In a most preferred embodiment, the heel cushion measures 20 Asker C.

A preferred embodiment incorporates honeycomb technology in the heel cushion. A honeycomb pattern is cut into a mold and the gel molded to provide the desired shape.

The heel cushion in the preferred embodiment is shaped with a wide base designed to correspond with the fatty area of the heel and generally tapers to a U-shape corresponding with the heel opening defined by the stability cradle.

The total thickness and size of the insole can vary depending on the shoe size, the application, and whether the insole is a removable insole or a permanent insole. In an exemplary men's size 9, the total thickness was found to be between but not limited to about 0.138 inches near the toes to about 0.445 inches in the arch area. Other dimensions that were measured were the length which was found to be but not limited to 11.062 inches and the width which ranged from but is not limited to 2.41 inches near the heel and 3.812 near the metatarsal region. The height of the insole ranged from but is not limited to 0.138 inches near the toes to 0.726 inches near the heel. The length and width of the insole will vary according to the shoe size for which the insole is intended, but the thickness in the same relative area will be similar to the exemplary insole.

The preferred embodiment of the invention is a triple density multi-layer insole. The triple density of the insole provides the following advantages: stability, shock absorption and cushioning.

Figure 2:
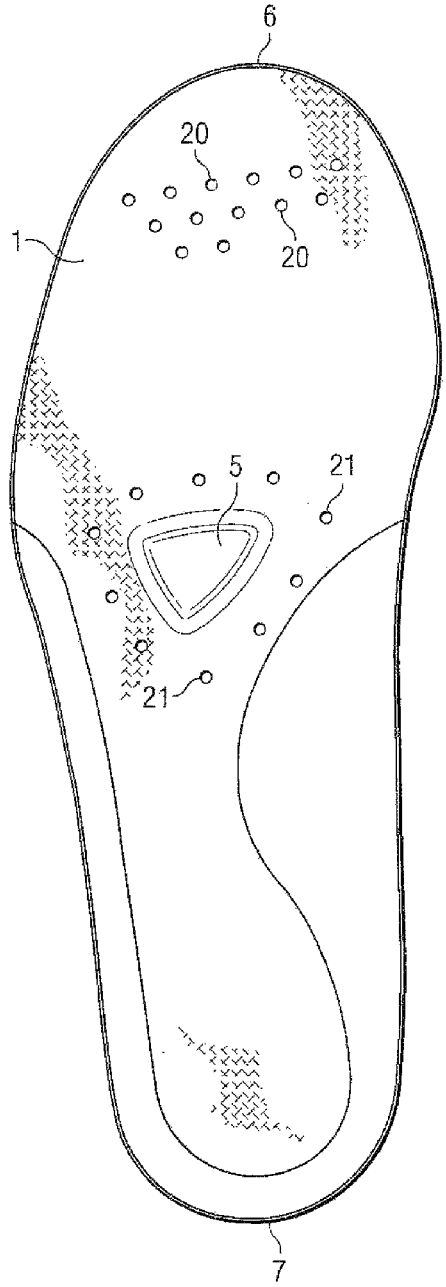
FIG. 2 is a top view of an embodiment of the present invention.

FIGS. 1-6 exemplify the invention by showing an insole designed for the left foot of a wearer. One skilled in the art would be able to construct an insole appropriate for the right foot as the mirror image of the left insole. A view of the bottom (shoe side) of the insole is best seen in FIG. 1. A view of the top (foot side) of the insole is best seen in FIG. 2. Referring to side views FIGS. 3 and 4, on the top side is a first top cloth layer (1). Layer (1) is secured to a second gel layer (2). Secured to the bottom (shoe) side of the second gel layer (2) is the stability cradle (3). The stability cradle (3) extends from the mid region of the insole's second gel layer (2) and extends to the back heel end (7) of the embodiment.

Still referring to FIG. 1, a stability cradle (3) is secured to the second gel layer (2). This stability cradle (3) starts around the mid length of the second gel layer (2) and extends to the back heel end (7) of the embodiment. Along the lower sides of the stability cradle (3) are ribbed edgings (31). The ribbed edgings (31) are effective in adding rigidity to the cradle. As best seen in FIG. 1, the stability cradle (3) defines two gap regions, the cradle heel gap (32) and the cradle metatarsal gap (33). The cradle metatarsal gap (33) is located between a first appendage (35) and a second appendage (36) of the stability cradle (3). The first appendage (35) extends forward and laterally from a central portion of stability cradle (3) and the second appendage (36) extends forward and medially from the central portion of stability cradle (3). The cradle heel gap (32) is located between a third appendage (37) and a fourth appendage (38) of the stability cradle (3). The third appendage (37) extends rearward and laterally from a central portion of stability cradle (3) and the fourth appendage (38) extends rearward and medially from the central portion of stability cradle (3). The third (37) and fourth (38) appendages continually extend vertically up and around the heel area and meet on the back end of the insole. The bottom surface of the gel layer (2) in the cradle heel gap (32) is not designed to be the bottom surface of the insole after the heel cushion (4) is inserted into the heel gap (32). The heel cushion (4) forms the bottom surface of the insole after assembly and in use.

Still referring to FIG. 1, the forefront honeycomb cushioning area (22) can be seen on the bottom surface of the insole. This area provides advanced cushioning to the weight placed upon the forefront of the user's foot and is integrally formed in the gel layer by providing a mold with the desired pattern and injection molding the cushioning area.

Heel cushion (4) is positioned in the cradle heel gap (32) and preferably incorporates honeycomb cushioning technology (41). This area provides advanced cushioning to heel when the user's weight is placed upon the heel of the foot during the heel strike operation in walking or running.

Figure 3:
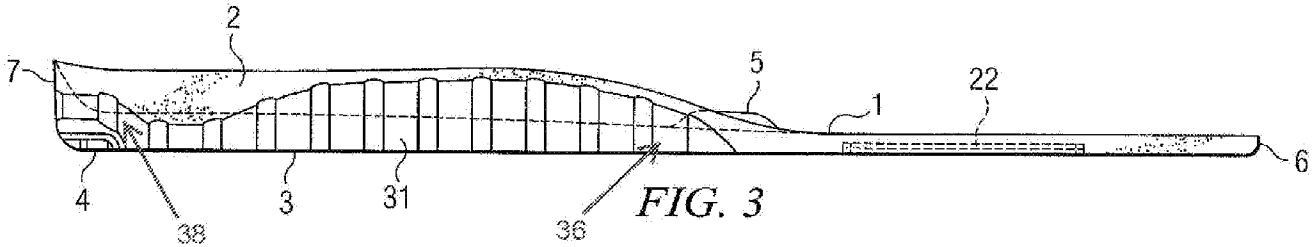
FIG. 3 is a left side view of an insole designed for the left foot of a wearer.
Figure 4:
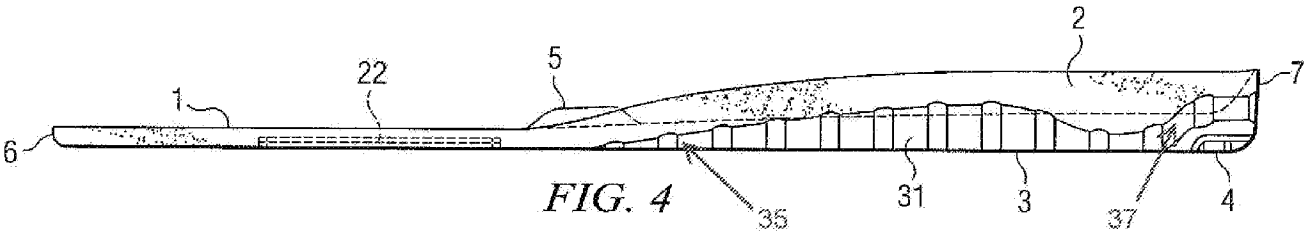
FIG. 4 is a right side view of an insole designed for the left foot of a wearer.

As shown in FIGS. 1, 2, 3, and 4, a raised area or metatarsal arch support (5) is located between the forefront honeycomb cushioning area (22) and the cradle metatarsal gap (33). The Metatarsal arch support is located within the stability cradle metatarsal gap. The metatarsal arch support is integrally formed in the top layer and gel layers. As best seen in FIG. 3, metatarsal arch support (5) extends upwardly from the top surface of the insole. In FIG. 1, the bottom view of metatarsal arch support (5) is shown and appears as a concave area from that view. This collapsible metatarsal arch support is achieved by providing a cavity in the top of the mold and an associated hump in the bottom of the mold. The collapsible metatarsal arch support adjusts to the wearer's foot whereas a permanent, static or solid arch is not able to support in the precise area of most importance to the particular wearer.

As shown in FIGS. 1 and 2, in a preferred embodiment optional toe venting apertures (20) are defined by the at least two layers near the front toe end (6) of the insole. The toe venting apertures (20) are small holes that pass through both the first top cloth layer (1) and the second gel layer (2) to allow user's foot to breathe. In a preferred embodiment the toe venting apertures (20) are small generally circular holes on the foot side of the first top cloth layer (1) that increase in size to generally oval shaped apertures while extending from the top layer through the second gel layer in the direction of the bottom (shoe side) of the insole (i.e. in the direction away from said first top cloth layer (1)). The preferred shape pumps air through the top holes during the walking operation. Other perforations may be employed throughout the insole to allow air flow and aid breathability.

Also visible in FIGS. 1 and 2 surrounding the metatarsal arch support are metatarsal breathing apertures (21) which are provided in a preferred embodiment. Formed in similar fashion as the toe breathing apertures (20) they allow the foot to breathe near the metatarsal area. Most preferred are cone-shaped holes which pump air into the shoe cavity during the walking operation.

Figure 5:
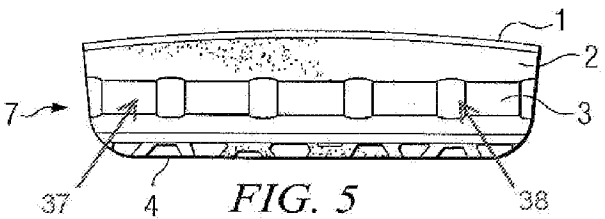
FIG. 5 is back side view of the heel area of an insole.

Preferably, the heel area, or back heel end (7) as shown in FIG. 5, of the insole is thicker than the toe area, or front toe end (6). This is best seen in FIG. 3. Generally, there will be less space in a shoe for an insole underlying the region fore of the metatarsal area.

Figure 6:
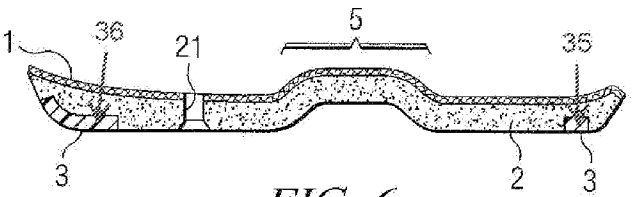
FIG. 6 is a cross-sectional view of FIG. 1 along line 6-6.

FIG. 6 shows a cross-section of the insole at 6-6. Shown in the center is a cross-sectional view of the raised area, or metatarsal arch support (5) aforementioned. To the left of the metatarsal arch support (5) is a cross-sectional view of one of the metatarsal breathing apertures (21) that surrounds the metatarsal arch support (5).

We claim:

1. A triple density replacement insole, comprising:

a generally foot-shaped substrate being placed in a foot receiving compartment of a shoe having a length extending from a heel area to an arch area to a toe area, said foot-shaped substrate having a front end, a back end, a medial side edge, a lateral side edge, a top surface and a bottom surface;

at least two coextensive layers adjacent and secured to one another and extending the length of the insole, said coextensive layers comprising a top cloth layer and a gel layer comprising a first density gel, said top cloth layer forming the top surface of said foot-shaped substrate;

a stability cradle adjacent said gel layer and forming a portion of said bottom surface, said stability cradle extending from the arch area to the heel area and secured to the gel layer, said stability cradle having a central portion located centrally in the arch area of said foot-shaped substrate and having a first appendage extending forward and laterally from said central portion substantially to said lateral side edge, a second appendage extending forward and medially from said central portion substantially to said medial side edge, a third appendage extending rearward and laterally from said central portion substantially to said lateral side edge and a fourth appendage extending rearward and medially from said central portion substantially to said medial side edge, said first and second appendages defining a metatarsal region area between said first and second appendages, said third and fourth appendages continually extending vertically up and around the heel area to a vertical heel area on the back end of said foot-shaped substrate with said third and fourth appendages meeting on said vertical heel area, said third and fourth appendages forming a heel region area between said third and fourth appendages, wherein the bottom surface of the foot-shaped substrate of said insole in the heel region area is not designed to be the bottom surface of the insole when the insole is assembled and in use;

an advanced cushioning area integrally formed in said gel layer, said advanced cushioning area located in said toe area along said bottom surface; and said heel cushion forming a portion of said bottom surface of said insole when said heel cushion is positioned in the heel region area adjacent to said gel layer and secured to said gel layer positioned in the heel region area.

2. The insole of claim 1, wherein said advanced cushioning area is a honeycomb pattern integrally formed in said gel layer.

3. The insole of claim 2, wherein said honeycomb pattern is positioned to lie generally below the ball of a user's foot.

4. The insole of claim 1, wherein said heel cushion comprises a second density gel which is softer than said first density gel.

5. The insole of claim 4, wherein said second density gel integrally forms a honeycomb pattern.

6. The insole of claim 1, further comprising a metatarsal arch support integrally formed in said foot-shaped substrate and located in said metatarsal region area, said metatarsal arch support extending dimensionally upwardly so that the metatarsal arch support extends out above the top surface of said foot-shaped substrate and forms a cavity in the bottom surface of said foot-shaped substrate.

7. The insole of claim 6, wherein said metatarsal arch support is collapsible.

8. The insole of claim 1, wherein said first density gel is a thermoplastic elastomer gel having a compression set less than about 11% when tested with ASTM F1614-95 testing standard.

9. The insole of claim 1, wherein said first density gel is selected from thermoplastic polyurethane elastomer ("TPU") gel and thermoplastic rubber gel ("TPR") gel.

10. The insole of claim 1, wherein said stability cradle comprises a thermoplastic elastomer gel having characteristics which provide rigidity to the area of the insole in which the stability cradle is secured.

11. A triple density replacement insole, comprising:

a generally foot-shaped substrate being placed in a foot receiving compartment of a shoe having a length extending from a heel area to an arch area to a toe area, said foot-shaped substrate having a front end, a back end, a medial side edge, a lateral side edge, a top surface and a bottom surface;

at least two coextensive layers adjacent and secured to one another and extending the length of the insole, said coextensive layers comprising a top cloth layer and a gel layer comprising a first density gel, said top cloth layer forming the top surface of said foot-shaped substrate;

a stability cradle adjacent said gel layer and forming a portion of said bottom surface, said stability cradle extending from the arch area to the heel area and secured to the gel layer, said stability cradle having a central portion located centrally in the arch area of said foot-shaped substrate and having a first appendage extending forward and laterally from said central portion substantially to said lateral side edge, a second appendage extending forward and medially from said central portion substantially to said medial side edge, a third appendage extending rearward and laterally from said central portion substantially to said lateral side edge and a fourth appendage extending rearward and medially from said central portion substantially to said medial side edge, said first and second appendages defining a metatarsal region area between said first and second appendages, said third and fourth appendages continually extending vertically up and around the heel area to a vertical heel area on the back end of said foot-shaped substrate with said third and fourth appendages meeting on said vertical heel area, said third and fourth appendages forming a heel region area between said third and fourth appendages, wherein the bottom surface of the foot-shaped substrate of said insole in the heel region area is not designed to be the bottom surface of the insole when the insole is assembled and in use;

an advanced cushioning area integrally formed in said gel layer, said advanced cushioning area located in said toe area along said bottom surface;

said heel cushion forming a portion of said bottom surface of said insole when said heel cushion is positioned in the heel region area adjacent to said gel layer and secured to said gel layer positioned in the heel region area; and a metatarsal arch support integrally formed in said foot-shaped substrate and located in said metatarsal region area, said metatarsal arch support extending dimensionally upwardly so that the metatarsal arch support forms a cavity in the bottom surface of said foot-shaped substrate.

12. The insole of claim 11, wherein said advanced cushioning area is a honeycomb pattern integrally formed in said gel layer, wherein said honeycomb pattern is positioned to lie generally below the ball of a user's foot.

13. The insole of claim 11, wherein said heel cushion comprises a second density gel which is softer than said first density gel.

14. The insole of claim 13, wherein said second density gel integrally forms a honeycomb pattern.

15. An insole comprising: a generally foot-shaped substrate being placed in a foot receiving compartment of a shoe having a length extending from a heel area to an arch area to a toe area, said foot-shaped substrate having a front end, a back end, a medial side edge, a lateral side edge, a top surface and a bottom surface; a metatarsal arch support integrally formed in said foot-shaped substrate and located in a metatarsal region area, said metatarsal arch support extending dimensionally upwardly so that the metatarsal arch support extends out above the top surface of said foot-shaped substrate and forms a cavity in the bottom surface of said foot-shaped substrate;

further comprising: at least two coextensive layers adjacent and secured to one another and extending the length of the insole, said coextensive layers comprising a to cloth layer and a gel layer comprising a first density gel, said to cloth layer forming the to surface of said foot-shaped substrate; a stability cradle adjacent said gel layer and forming a portion of said bottom surface, said stability cradle extending from the arch area to the heel area and secured to the gel layer, said stability cradle having a central portion located centrally in the arch area of said foot-shaped substrate and having a first appendage extending forward and laterally from said central portion substantially to said lateral side edge, a second appendage extending forward and medially from said central portion substantially to said medial side edge, a third appendage extending rearward and laterally from said central portion substantially to said lateral side edge and a fourth appendage extending rearward and medially from said central portion substantially to said medial side edge, said first and second appendages defining a metatarsal region area between said first and second appendages, said third and fourth appendages continually extending vertically up and around the heel area to a vertical heel area on the back end of said foot-shaped substrate with said third and fourth appendages meeting on said vertical heel area, said third and fourth appendages forming a heel region area between said third and fourth appendages, wherein the bottom surface of the foot-shaped substrate of said insole in the heel region area is not designed to be the bottom surface of the insole when the insole is assembled and in use;

said heel cushion forming a portion of said bottom surface of said insole when said heel cushion is positioned in the heel region area adjacent to said gel layer and secured to said gel layer positioned in the heel region area, wherein said heel cushion has a honeycomb pattern integrally formed therein; and an advanced cushioning area integrally formed in said gel layer and located in said toe area, wherein said advanced cushioning area is a honeycomb pattern integrally formed in said gel layer, wherein said honeycomb pattern is positioned to lie generally below the ball of a user's foot.

16. The insole of claim 15, wherein said heel cushion and said advanced cushioning area comprise a second density gel which is softer than said first density gel.

* * * * *

UNITED STATES PATENT AND TRADEMARK OFFICE

CERTIFICATE OF CORRECTION

PATENT NO. : 8,745,894 B2
APPLICATION NO. : 12/668983
DATED : June 10, 2014
INVENTOR(S) : Cheskin et al.

It is certified that error appears in the above-identified patent and that said Letters Patent is hereby corrected as shown below:

In the Claims

Claim 15, Col. 8, line 34, delete "comprising a to cloth" and insert -- comprising a top cloth --
Claim 15, Col. 8, line 36, delete "to cloth layer forming the to surface" and insert -- top cloth layer forming the top surface --

Signed and Sealed this
Twenty-sixth Day of August, 2014

Michelle K. Lee

Michelle K. Lee
*Deputy Director of the United States Patent and Trademark Office*